United States Patent [19]

Robbins

[11] Patent Number: 4,823,679

[45] Date of Patent: Apr. 25, 1989

[54] BUILDING VENTILATION SYSTEM WITH AIR INLET FLAP CONTROL

[76] Inventor: R. Ralph Robbins, 62 Thatcher Drive, Winnipeg, Manitoba, Canada, R3T 2L3

[21] Appl. No.: 188,534

[22] Filed: Apr. 29, 1988

[51] Int. Cl.[4] ..... F24F 7/007

[52] U.S. Cl. ..... 98/33.1; 98/37; 98/40.05; 98/119

[58] Field of Search ..... 98/33.1, 37, 39.1, 40.05, 98/40.17, 116, 119, 114

[56] References Cited

U.S. PATENT DOCUMENTS

| | | | |
|---|---|---|---|
| 1,975,316 | 10/1934 | Ferris | 98/37 |
| 2,022,143 | 11/1935 | Mottershall . | |
| 2,057,627 | 10/1936 | Ferris . | |
| 2,464,000 | 3/1949 | Schild | 98/119 |
| 2,502,736 | 4/1950 | Marcoe | 98/37 X |
| 2,599,075 | 6/1952 | Stroup | 98/119 |
| 2,624,265 | 1/1953 | Mader | 98/119 |
| 2,775,928 | 1/1957 | Morrison | 98/119 |
| 2,814,977 | 12/1957 | Noll | 98/37 |
| 2,862,438 | 12/1958 | Mader | 98/116 |
| 3,057,288 | 10/1962 | Papsdorf | 98/119 |
| 3,250,206 | 5/1966 | Strouth | 98/119 |
| 3,368,756 | 2/1968 | Edwards | 236/49 |
| 3,842,722 | 10/1974 | Miller | 98/119 |
| 3,865,021 | 2/1975 | De Lepeleire | 98/37 X |
| 4,022,117 | 5/1977 | Mallian | 98/119 X |
| 4,241,871 | 12/1980 | Newell, III et al. | 236/49 |
| 4,249,461 | 2/1981 | Christenson et al. | 119/21 X |
| 4,334,577 | 6/1982 | George | 98/119 X |
| 4,457,215 | 7/1984 | Vogt | 98/119 X |
| 4,498,373 | 2/1985 | Dittmer et al. | 98/33.1 |
| 4,534,278 | 8/1985 | Spilde | 98/37 |
| 4,557,247 | 12/1985 | Hara et al. | 98/33.1 X |
| 4,616,696 | 10/1986 | Brundrett et al. | 98/33.1 X |

*Primary Examiner*—Harold Joyce

*Attorney, Agent, or Firm*—Adrian D. Battison; Stanley G. Ade; Murray E. Thrift

[57] ABSTRACT

In a ventilation system for a building in which air is extracted by a fan arrangement, an inlet flap arrangement is provided for a ceiling opening which comprises a foamed material flap member mounted directly covering the ceiling opening. The flap member is controlled by a tension spring biasing it to a closed position so that its weight and air pressure act to open the flap. The angle of the spring relative to the position of the center of gravity of the flap member are controlled to provide the required opening characteristics. In one arrangement the flap member is shaped as a scoop so as to direct air along the ceiling when opened.

30 Claims, 4 Drawing Sheets

BUILDING VENTILATION SYSTEM WITH AIR INLET FLAP CONTROL

BACKGROUND OF THE INVENTION

This invention relates to a building ventilation system and particularly to an inlet flap arrangement which automatically controls air movement through an inlet opening in dependence upon a reduction in pressure within the interior of the building.

In various buildings with particular attention to animal husbandry barns, it is important to maintain air quality at required levels to ensure proper health and survival of the animals contained.

For maximum efficiency it is often required to provide maximum density of animals within the barn and hence the entry of fresh air into the building is essential to maintain the atmosphere within the building at proper levels so as to reduce the concentrations particularly of water vapour and ammonia. By proper introduction of fresh air, the health of the livestock and the operator is protected.

In many cases air control is provided by air extraction fans which pull contaminated air from the interior of the building for direct extraction to the exterior. It is then necessary to replace the extracted air with incoming air. This can of course be achieved merely by providing suitable openings which allow air to flow directly into the interior of the building. However such openings have a number of disadvantages. Firstly the openings cannot be closed and hence air flow cannot be controlled even though the fans may be rendered inoperative. Air movement may continue by way of external air pressure on the building and by way of convection currents. Secondly the air entering into the interior of the building is not controlled in its direction. In this regard it is important in many cases to control the air direction either to ensure that it is properly presented as fresh cooling air directly on to animals that require cooling or in other cases to avoid air being directed straight to animals in such cases where the animals are small and can be killed by excess cooling.

Various designs of inlet duct have been made available and in particular there are provided various arrangements which can be mounted to provide a housing which projects through the wall of the building with the housing possibly including in some cases directional control louvres or plates which direct the air in the particularly required direction either onto or away from the animals as required. Housings of this type in some cases can also include within the housing a flap valve which can open and close automically in dependence upon air pressure across the valve so as to prevent any unwanted backflow of air and also to effectively totally halt the flow of air when no air is required.

However devices of this type have the disadvantage that they are very expensive in comparison with the provision of a simple opening and in large barns of course many such inlet control devices are necessary. Part of this cost penalty is due to the fact that it is necessary to provide a moveable flap valve and in addition to seperately provide control surfaces for guiding the air in the required directions.

SUMMARY OF THE INVENTION

It is one object of the present invention, therefore, to provide an improved inlet arrangement for use in building ventilation system.

According to the first aspect of the invention, therefore, there is provided in a building having walls and a substantially horizontal ceiling defining a substantially closed interior area of the building, an air ventilation system comprising air extraction means for withdrawing air from the area, and an air inlet means separate from the air extraction means for allowing air into the area to replace air withdrawn therefrom, the air inlet means comprising an opening formed in the ceiling through which air can pass, a flap member, hinge means of said flap member being mounted directly on the ceiling for pivotal movement of the flap member about an axis along one side of the opening such that the flap member can move from a closed position covering the opening and preventing air movement therethrough to an open position in which the flap member extends from the axis downwardly to allow air to pass through the opening, and spring means biasing the flap member to a closed position.

According to a second aspect of the invention, there is provided for use in a building having walls and a substantially horizontal ceiling defining a substantially closed interior area of the building and an air ventilation system comprising air extraction means for withdrawing air from the area, a kit of parts for forming an air inlet means for allowing air into the area to replace air withdrawn therefrom comprising a flap member, formed of a foamed plastics material panel, hinge means for mounting said flap member for pivotal movement of the flap member about an axis along one side of an opening such that the flap member can move from a closed position covering the opening and preventing air movement therethrough to an open position in which the flap member extends from the axis downwardly to allow air to pass through the opening, and tension spring means for attachment to said flap member for biasing the flap member to a closed position covering said opening said hinge means being adapted for direct attachment to a surface surrounding the opening.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
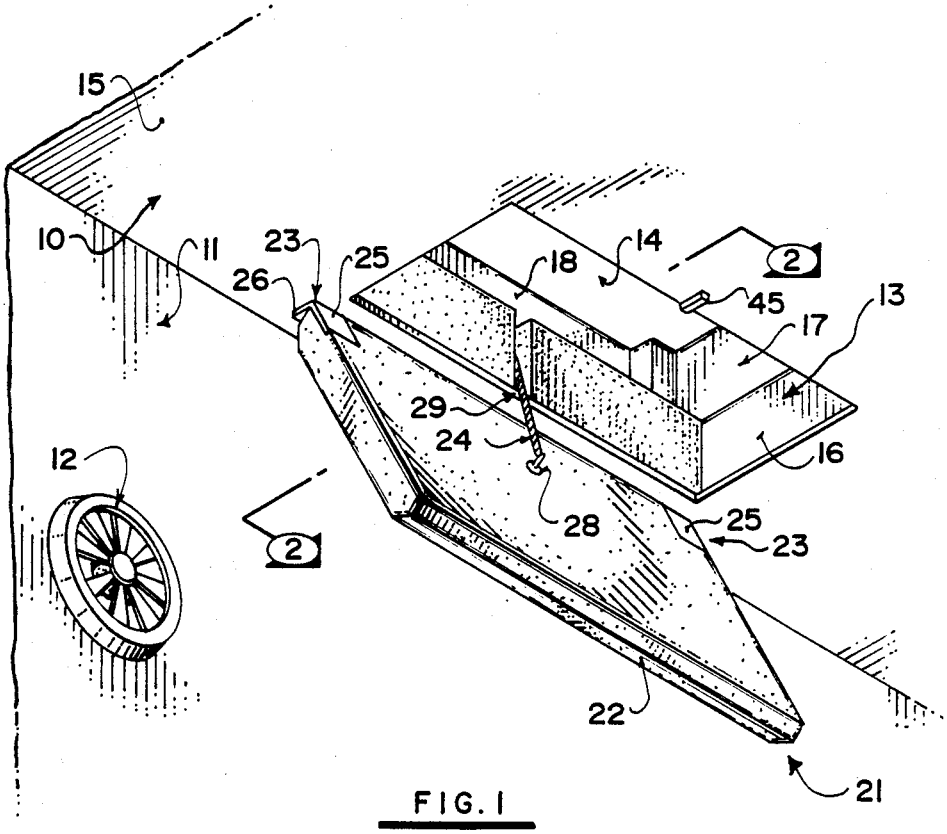
FIG. 1 is an isometric view showing a part of a building including an air inlet provided in the ceiling of the building and a flap member for controlling movement of air therethrough.
Figure 2:
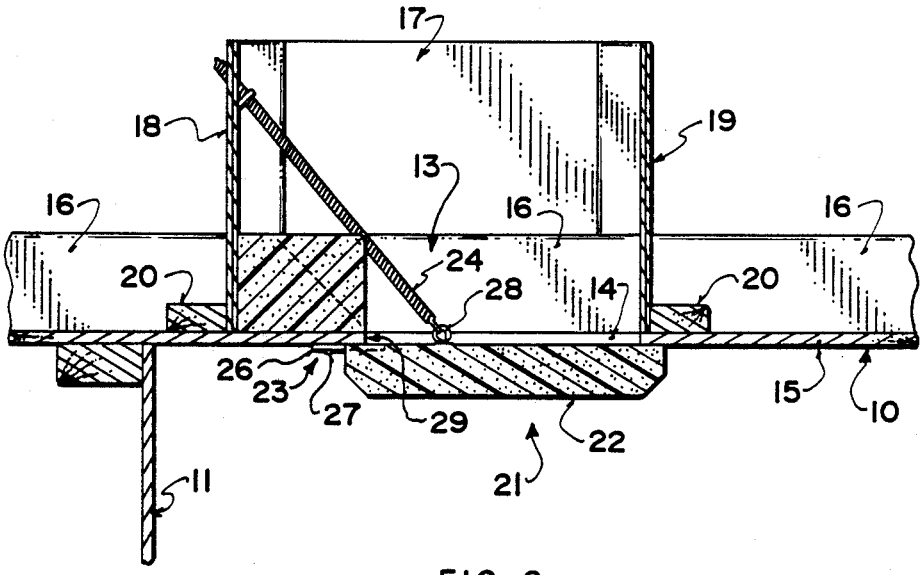
FIG. 2 is a cross sectional view along the lines 2—2 of FIG. 1.

In FIGS. 1 and 2 is shown a first arrangement of the building ventilation system in which the building is illustrated with a ceiling indicated at 10 and one wall indicated at 11 defining what is generally a closed interior area of the building including further walls, doors as necessary to complete the structure as will be well known to one skilled in the art.

In the wall 11 is provided a fan schematically indicated at 12 which may be one of a number of such fans which act to extract air under automatic or manual control from the interior of the building as that air becomes contaminated with moisture, ammonia or excess heat.

A plurality of air inlets are provided to allow air to enter the interior of the building to replace the air extracted by the panel of fans 12. One of the inlets is shown in FIGS. 1 and 2 and is indicated generally at 13. Specifically the inlet 13 comprises an opening 14 defined in the ceiling 10 and formed simply by cutting a rectangular hole in the sheathing material of the ceiling. The sheathing material is indicated at 15 and is carried upon ceiling joists 16 of conventional construction. The size of the opening is preferably chosen so that it extends between two such joists 16 which may in one example be on 24 inch spacing.

Above the ceiling sheathing 15 and between the joists 16 is provided a rectangular box construction 17 which acts as a retaining barrier for insulation material sitting on the sheathing 15, if such is provided. Walls of the box structure are shown at 18 and 19 which extend across between the joists 16 and supported in place by transverse batons 20.

The inlet opening thus formed allows air to enter in an uncontrolled manner from the roof space or area above the ceiling into the interior of the building to replace the air withdrawn by the fan 12. Control of the air movement is provided by an inlet control device generally indicated at 21 which includes a flap member 22, a hinge mounting mechanism 23 and a control spring 24.

The flap member 22 is formed from a sheet of foamed material having a thickness which may in one example be of the order two inches and which defines a flat upper surface and a flat lower surface with the side edges chamfered to provide a pleasing appearance. The panel of the foamed material is rectangular in shape having a length of approximately 24 inches and a width of the order of 12 inches enabling it to span and fully cover the opening 14.

The hinge mechanism 23 comprises a pair of flexible hinge members each arranged at an end of the panel and bridging one side edge of the panel. One portion of the flexible hinge member is firmly attached into a recess 25 shaped to receive the hinge member and of a depth sufficient just to receive the hinge member so that the outer surface of the hinge member is flush with the upper surface of the panel. A trailing part of the hinge member indicated at 26 extends beyond the edge of the panel so that it can be attached to the ceiling by a screw indicated in FIG. 2 at 27 which passes through a washer (not shown), through the flap of the hinge member and into the joist 16 to provide a firm attachment of the flap member to the ceiling.

The sharp edge of the panel at the hinges provides a hinge line around which the flap member can pivot as controlled by the hinge members 23.

The spring 24 comprises a tension spring preferably of the coil spring type which is attached to a hook 28 on the upper surface of the panel at a position thereon halfway along the length of the panel but spaced from the longitudinal centre line toward the hinge members 23 thus ensuring that the spring acts to push the flap member toward the hinge members to reduce forces thereon. The spring is inclined upwardly from the upper surface of the panel and in a direction toward the axis defined by the edge of the panel about which pivotal movement takes place. The upper end of the spring is attached to the wall 18 at a position adjacent its upper edge.

As the panel 22 is formed of a foamed material for example, polystyrene foam, it has an insulating effect when closed so as to at least partly replace the insulation in the ceiling removed by the presence of the opening. However such foamed material has a significant mass.

The flat foamed plastic panel 22 thus pivots around the hinges 23 in dependence upon differences in air pressure on the upper surface and on the lower surface caused by a reduction in pressure within the building. The panel member has its centre of gravity at or near the same elevation as the pivot axis and is held forcibly against the ceiling by the spring 24 which is attached to the hook or rotating pivot 28 at the lower end and to an adjustable connection at the upper end attached to the wall 18. The upper connection it will be noted from FIG. 2 is on an opposite side of the pivot axis to the coupling 28 so that as the flap member moves through an arc in its opening direction, there is generated a progressively reducing effective force arm of the spring on the flap member so that the increasing tension of the spring is partly offset by the reducing force arm. In other words, the resultant increase in torque on the flap member around the hinge axis is relatively small.

At the same time the torque applied by the weight of the flap member around the hinge axis gradually reduces as the flap member is opened since the centre of gravity moves closer to a vertical plane containing the hinge axis.

The tension in the spring is controlled so that the flap member can rotate to its open position at an angle of the order of 60° from the horizontal. This amount of rotation results in such a significant reduction of the effective force arm of the spring that the torque exerted by the spring, after a point, actually declines. This decline is halted by the provision of a stop member indicated at 29 which is engaged by the spring 24 after opening of the flap member to an angle approaching the required angle of 60°. Without preventing such decline, the inlet would hang in the wide open position even when some of the exhaust fans are shut down so that large volumes of air would continue to enter the interior when reduced volumes are required.

The stop member 29 can be adjustable or fixed and in the arrangement illustrated is provided simply by an edge of the opening which is arranged to be a required distance from the hinge line by adjusting the position of the hinges on the ceiling accordingly. Because the spring is held against the edge of the opening, the tendency is for the lower end of the spring to do the majority of any further stretching thus providing a greater increase in tension of the spring for further movement of the flap member than would be the case if the entire spring was being stretched uniformly.

The above arrangement of inlet control has the advantages that when reduced amounts of air are required for example during the cooler periods, the flap member only opens over a small extent thus acting to retain air movement in a direction parallel to the upper surface of the flap member so that it runs basically along the underside of the ceiling for mixing with warm air before moving to the animals.

When however more air is required for example during warm weather, the inlet opens wide to an angle of approximately 60° and permits the roof space air to drop down directly to floor level so as to apply the benefit from the cooling air directly onto the livestock beneath the ceiling.

The flap member thus acts to directly control the movement of air through the opening and in addition to control the direction of the air so that its effect is properly managed in dependence upon the circumstances.

A stop member 45 can be provided mounted upon the ceiling and extending over a short length of the ceiling so as to hold the edge of the flap member away from sealing contact with the ceiling to allow a continual slight flow of air past the flap member even in the fully closed position. This can be used to avoid freezing of relatively stationary moist air around the flap member which can in some severe cases cause the flap member to adhere to the underside of the ceiling and prevent its opening when required.

In a further arrangement (not shown) the flap member can be arranged to cooperate with an opening in an inclined surface for example a surface inclined between the wall and ceiling of the barn. In this case, an additional counterbalance mass is applied to the flap member extending upwardly therefrom so as to raise the centre of gravity of the flap member as a whole to approximately the height of the hinge line. In this way, the weight of the flap member continues to generate a torque in an opening direction as the flap member moves toward the open position.

Figure 3:
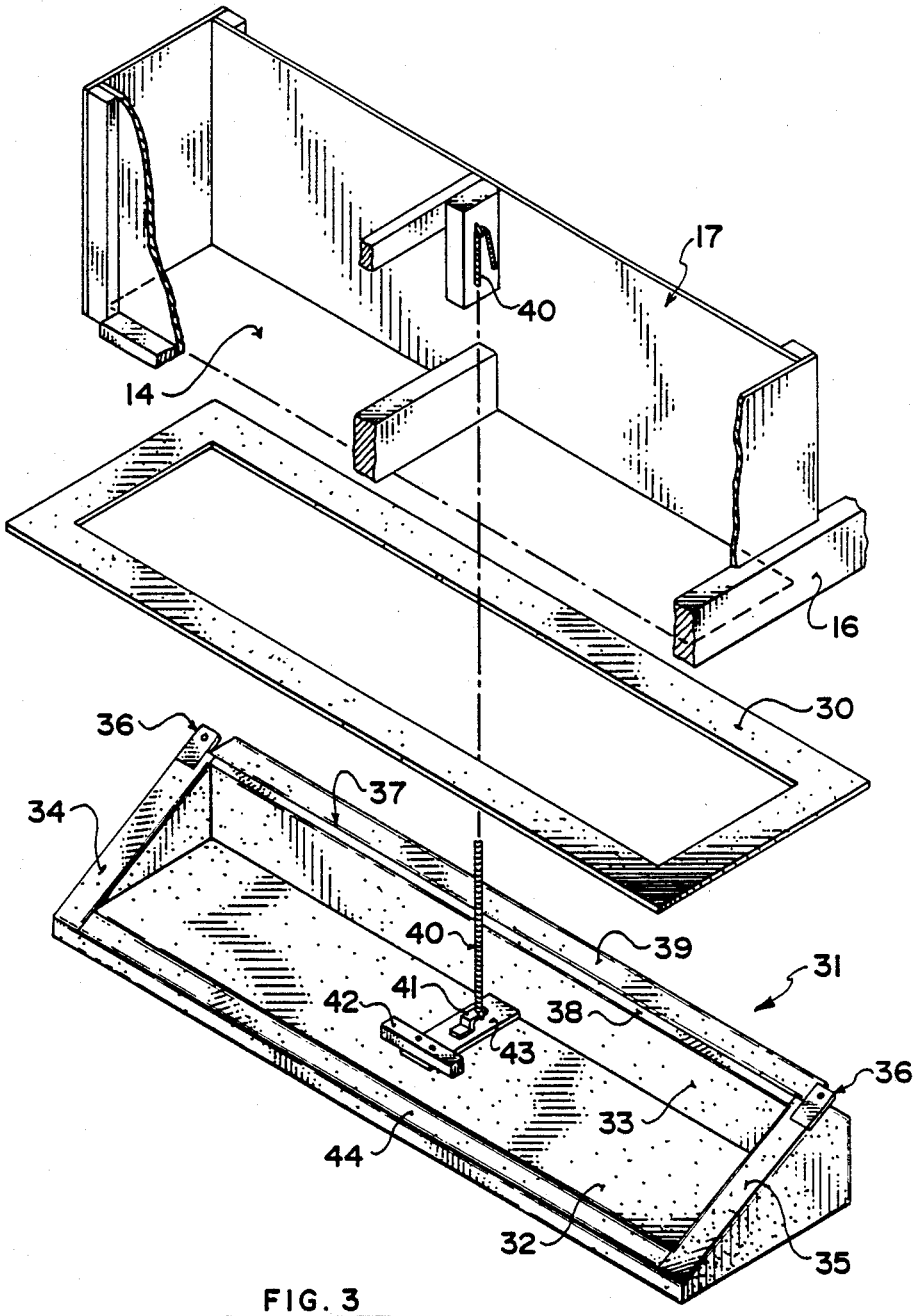
FIG. 3 is an exploded isometric view showing an opening similar to the opening of FIG. 1 controlled by an alternative form of flap member.
Figure 4:
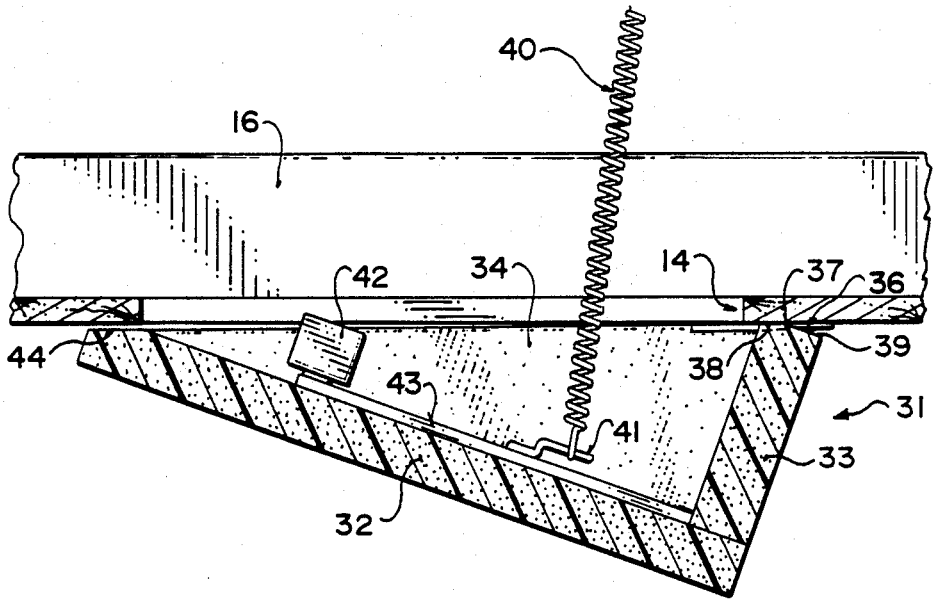
FIG. 4 is a transverse cross sectional view through the arrangement of FIG. 3 showing the flap member in a closed position.
Figure 5:
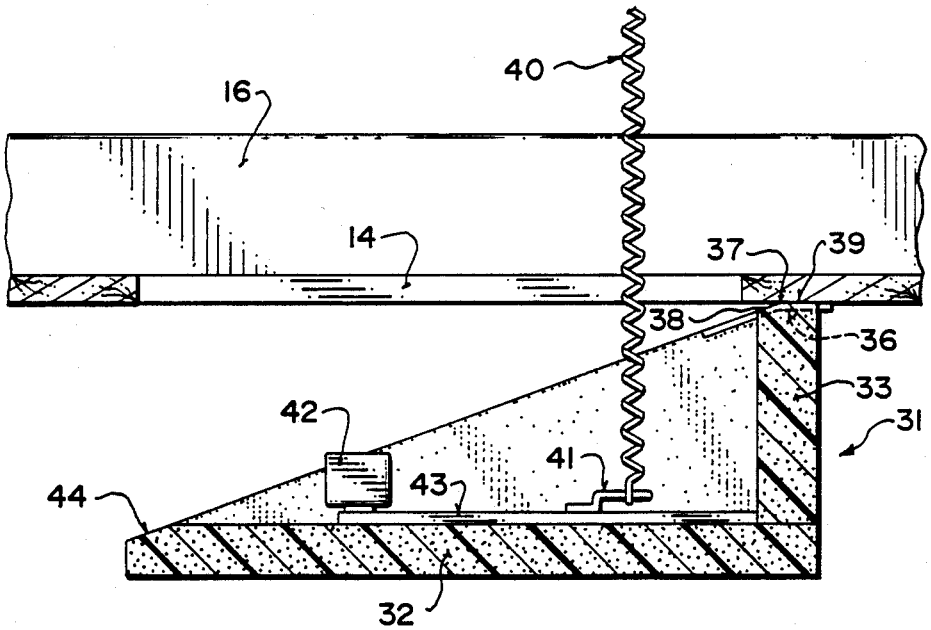
FIG. 5 is a cross sectional view similar to FIG. 4 showing the flap member in the opened position.

Turning now to FIGS. 3, 4 and 5, there is shown an opening 14 in the ceiling substantially as previously described including a box construction 17 mounted above the opening. A ceiling trim 30 is provided for attachment to the undersurface of the ceiling. This trim is omitted from the illustration of FIGS. 4 and 5 for convenience. The trim 30 is formed from a strip of polystyrene foam. In severe climates this trim prevents condensation at the ceiling which otherwise could collect in the inlet and act as an additional weight interfering with the spring controlled operation. In addition, for use with poultry or other high insulation requirement, a rubber gasket (not shown) can be attached between the trim and the flap member, the gasket being attached at an inner edge and hanging downwardly to act as a seal with the flap member. The gasket is not essential and is provided only in cases where improved sealing of the air flow in the closed position is necessary.

A modified flap member is shown in FIGS. 3, 4 and 5 and is indicated generally at 31. The flap member is L-shaped in cross section defining a first plate portion 32 and a second plate portion 33 arranged at right angles thereto and of reduced length as best shown in FIG. 4. At the ends of the flap member is provided a pair of triangular end members 34 and 35 which are shaped so that two sides coincide with the outer edges of the plate portions 32 and 33 and the third side of the triangular member follows a line joining the upper edges of the plate member 32 and 33. In this way as best shown in FIG. 4, the upper edges of the plate members 32 and 33 can lie in contact with the ceiling on either side of the opening 14 with the end members 34 and 35 at the ends of the opening 14. In this way the flap member defines a rectangular upper face as best shown in FIG. 3 which engages the ceiling around the opening 14 to hold the opening closed in the position shown in FIG. 4.

The flap member is hinged to the ceiling in a manner similar to that previously described employing flexible hinge strips 36 and 37 which can be formed of neoprene which are attached to the end members 34 and 35 at the apex thereof adjacent the upper edge of the plate member 33 and are attached by screws passing through the trim.

As best shown in FIG. 3, the triangular member 35 is shaped to form an apex 37 defining a pivot axis. The apex 37 coincides with a flat portion 38 of the upper edge of the plate member 33 with a further portion of the upper edge inclined relative thereto and indicated at 39 with the angle between the flat portion 38 and the incline portion 39 being of the order of 30° (in the example shown) to enable the device to open through an angle of the order of 30° at which time the surface 39 engages the under surface of the ceiling in the position shown in FIG. 5. Similarly to the previous embodiment, the flap member is controlled by a spring 40 which extends upwardly from a hook member 41 on an upper surface of the flap member. In this case the angle of the spring 40 from vertical is very much reduced relative to the angle of the spring 24. An additional mass 42 is mounted on the flap member at a position slightly raised from the upper surface of the plate member 32 with both the mass 42 and the hook member 41 being carried on a plate 43 which provides sufficient strength to accomodate the forces involved and to transmit those forces to the relatively weaker plastics foam material from which the flap member is formed.

The edge of the plate member 32 at its point of contact with the underside of the ceiling is chamfered as indicated at 44 so as to provide a line of contact with the ceiling.

The type of flap member shown in FIGS. 3, 4 and 5 defines a scoop-type air inlet which is shaped so as to direct fresh air entering through the opening 14 onto the ceiling even in its wide open position. In this way, young livestock such as chicks and caged livestock such as dry sows are not subjected to cold blasts of air which could result in sickness and even death.

Because the flap member is scoop-shaped, there is sufficient material in it to obtain a weight of approximately two pounds. As well its shape results in a centre of gravity that is significantly below the line around which it is pivoted defined by the apex 37. As the inlet opens this centre of gravity describes an arc around the hinge line progressively reducing its rotational force (torque) against which the spring tension is adjusted for proper closure of the ceiling opening. This reduction of opening torque resulting from the shift of the flap member's centre of gravity causes the flap member to require much greater pressure difference across it in order to continue opening. In fact at approximately 40 percent of its travel toward the open position, very little further opening occurs until the pressure difference has risen to almost the full operating pressure considered acceptable. At this point the inlet suddenly swings to its wide open position. This is due to the fact that the arc described by the lower rotating spring pivot as the inlet opens results in a substantial reduction of the spring's effective force arm. As well, the pressure difference across the inlet was extra-ordinary before the shift to the wide open position because of the loss of opening torque described above. This excess pressure and the reduction of the spring's effective force arm are responsible for the sudden swing to the wide open position. As a typical installation includes many inlets in one area, this non-linearity in its operation results in some units swinging into the wide open position ahead of others because of slight differences in adjustment.

By installing the weight 42, the centre of gravity of the flap member as a whole is shifted so that it is further away from and slightly below the hinge line. With this arrangement the opening torque caused by the weight of the assembly is not reduced as significantly and the non-linearity described above is largely eliminated.

Relatively uniform operation of the inlet is obtained by proper adjustment of the spring tension. The spring tension is adjusted by movement of the upper end of the spring in its attachment to a mounting block 46 carried in on an inner face of the box 17 as shown in FIG. 3.

The upper end of the spring pivot is located so that the upper end of the spring leans slightly toward the hinge line as best shown in FIG. 4. In addition the lower connection of the spring at the hook member 41 is well below the hinge line so that as the inlet opens the arc described by this pivot significantly reduces the effective force arm of the spring. This arrangement allows the inlet to open much further against the increasing spring tension which is partly offset by the progressive reduction of the effective force arm.

It should be noted that a stop is not required for the spring in this arrangement as is required for the device relatively illustrated in FIGS. 1 and 2. This is due to the fact that the flap member in this case only rotates through an angle of the order of 30° so that the reduction of the effective force arm is not as great.

In broiler barns which start up with young chicks requiring high temperatures and very little ventilation, the sealing trim 30 including the gasket (not shown) can be used. The sealing trim 30 consists of a one half inch strip of styrofoam fitted with the flexible gasket which lays against the flap member. To the upper surface of the trim 30, two beads of caulk can be applied to attach the trim to the ceiling. The trim and the flap member are located at the ceiling with the spring hooked onto its upper and lower connections forcing the flap member against the trim.

Figure 6:
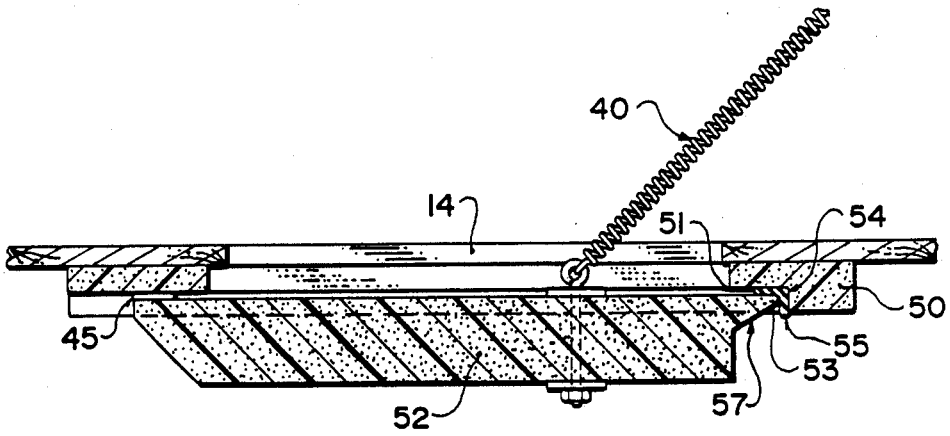
FIG. 6 is a cross sectional view similar to FIG. 2 of an alternative mounting arrangement for the flap member.
Figure 7:
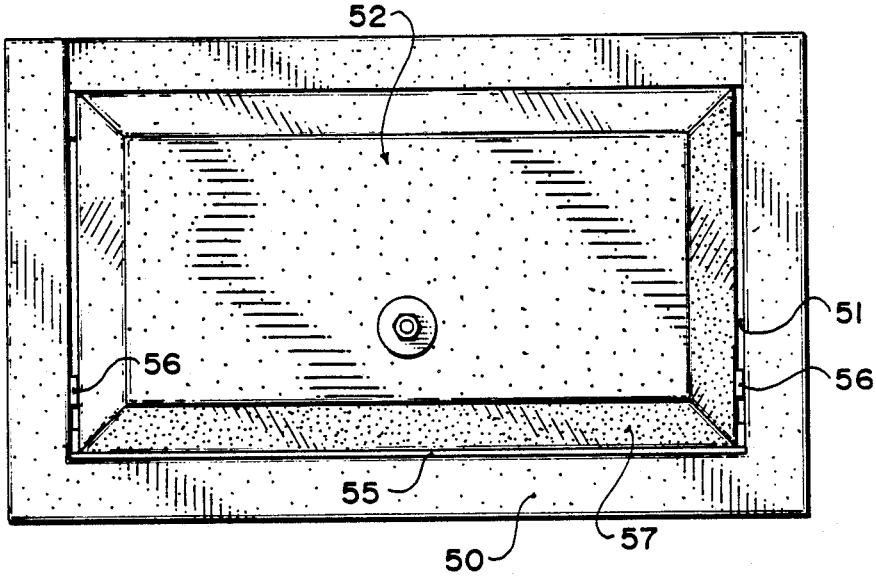
FIG. 7 is an underside view of the arrangement of FIG. 6.

In the arrangement of FIGS. 6 and 7, a device is shown which is substantially of the same construction as that shown in FIGS. 1 and 2 except that in this case a surrounding insulating trim 50 is provided which is rectangular in shape so as to define a strip extending a short distance outwardly from the opening 14. In this case the trim 50 is raised along the hinge line and two sides to define a recess 51 into which the flat-type flap member 52 can be received.

In place of the flexible strip type hinge members of FIGS. 1 and 2, in this case the hinging action is provided between an apex 53 of the flap member 52 which engages into a right angled receiving area 54 of the trim 50. The right angled receiving area can be reinforced by a right angle strip 55 formed of a rigid plastics material. Side to side movement of the flap member 52 is prevented by spring loops 56 formed of plastic strip which act to centre the flap member within the recess 51 to allow it to freely pivot within the area 54. As shown best in FIG. 6, in the closed position the upper surface of the flap member engages one side of the strip 55. In the open position (not shown) a side surface 57 of the flap member is arranged at an angle of the order of 60° to the upper surface so as to engage the other side of the strip 55 and tend to restrain the flap member to the opening angle of 60°.

The two raised sides and the raised edge of the trim act to confine the air to escape over the fourth edge remote from the hinge line so as to assist in controlling air movement and improving air mixing.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. In a building having walls and a substantially horizontal ceiling defining a substantially closed interior area of the building, an air ventilation system comprising air extraction means for withdrawing air from the area, and an air inlet means separate from the air extraction means for allowing air into the area to replace air withdrawn therefrom, the air inlet means comprising an opening formed in the ceiling through which air can pass, a flap member, hinge means of said flap member being mounted directly on the ceiling for pivotal movement of the flap member about an axis along one side of the opening such that the flap member can move from a closed position covering the opening and preventing air movement therethrough to an open position in which the flap member extends from the axis downwardly to allow air to pass through the opening, and spring means biasing the flap member to a closed position.

2. The invention according to claim 1 wherein the flap means is arranged in a fully open position thereof to extend across the opening such that an upper surface of the flap means acts as a guide surface for the air passing through the opening.

3. The invention according to claim 1 wherein the spring means comprises an extension spring connected to an upper side of the flap member and extending through the opening for connection to the ceiling on an upper side thereof above the opening.

4. The invention according to claim 3 wherein the extension spring extends from the flap member in a direction inclined toward a vertical plane including the axis such that as the flap member moves toward the open position, the mechanical advantage of the spring relative to the axis decreases as the centre of gravity of the flap member moves towards the axis.

5. The invention according to claim 4 including a stop member arranged to engage the spring to prevent the reduction of the mechanical advantage beyond a predetermined minimum and thus to inhibit opening of the flap member beyond the predetermined angle.

6. The invention according to claim 1 wherein the flap member is formed from a foamed plastics material panel.

7. The invention according to claim 1 wherein said hinge means comprises flexible fabric pieces directly attached to the flap member and directly attached to the ceiling.

8. The invention according to claim 7 wherein the fabric pieces are arranged at ends only of the flap member.

9. The invention according to claim 1 wherein the flap member comprises a substantially flat panel and wherein the spring means comprises an extension spring attached to an upper side of the flap panel at a position thereon spaced from the hinge means by a distance less than half the width of the panel and extending therefrom in a direction inclined toward a vertical plane containing the axis and wherein there is provided a stop member for engaging the spring as the flap member moves towards an opened position thereof to limit the movement of the flap member beyond a predetermined angle.

10. The invention according to claim 1 wherein the flap member is substantially L-shaped in cross section arranged such that one extremity of the L-shape engages said ceiling at said axis and extends therefrom towards an apex spaced from the ceiling with the other extremity of the L-shape engaging the ceiling on the side of the opening spaced from the axis and including triangular pieces closing ends of the L-shape and defining a substantially flat surface for engaging the ceiling at the ends of the flap member such that in the opened position the leg of the L-shape adjacent the opposed extremity lies across the opening to direct air therefrom across the ceiling in a direction substantially parallel thereto.

11. The invention according to claim 1 including an additional mass attached to said flap member so as to adjust the centre of gravity thereof.

12. The invention according to claim 1 including a projecting member cooperating between the ceiling and the flap member so as to hold the flap member in a slightly opened position to allow continual movement of air therepassed to prevent freezing.

13. The invention according to claim 1 including a gasket member mounted on the ceiling against which edges of said flap member engage.

14. The invention according to claim 1 wherein the flap member is shaped to define an apex thereof at said axis and engaging said ceiling along said axis and is shaped to define surfaces thereof, a first surface of which engages said ceiling in said closed position thereof and a second surface of which is arranged at an angle thereto to engage the ceiling in a fully opened position of the flap member so as to define an angle of movement of the flap member.

15. The invention according to claim 1 including a foamed member surrounding the opening and defining surfaces for engagement by said flap member, said foamed member defining an angle into which an edge of the flap member is pulled by said spring member, said angle defining said hinge means about which said flap member pivots.

16. For use in a building having walls and a substantially horizontal ceiling defining a substantially closed interior area of the building and an air ventilation system comprising air extraction means for withdrawing air from the area, a kit of parts for forming an air inlet means for allowing air into the area to replace air withdrawn therefrom comprising a flap member, formed of a foamed plastics material panel, hinge means for mounting said flap member for pivotal movement of the flap member about an axis along one side of an opening such that the flap member can move from a closed position covering the opening and preventing air movement therethrough to an open position in which the flap member extends from the axis downwardly to allow air to pass through the opening, and tension spring means for attachment to said flap member for biasing the flap member to a closed position covering said opening, said hinge means being adapted for direct attachment to a surface surrounding the opening.

17. The invention according to claim 16 wherein the flap member is arranged in a fully open position thereof to extend across the opening such that an upper surface of the flap member acts as a guide surface for the air passing through the opening.

18. The invention according to claim 16 wherein the spring means comprises an extension spring connected to an upper side of the flap member and extending through the opening for connection to the ceiling on an upper side thereof above the opening.

19. The invention according to claim 18 wherein the extension spring extends from the flap member in a direction inclined toward a vertical plane including the axis such that as the flap member moves toward the open position, the mechanical advantage of the spring relative to the axis decreases as the centre of gravity of the flap member moves towards the axis.

20. The invention according to claim 19 including a stop member arranged to engage the spring to prevent the reduction of the mechanical advantage beyond a predetermined minimum and thus to inhibit opening of the flap member beyond the predetermined angle.

21. The invention according to claim 16 wherein the flap member is formed from a foamed plastics material panel.

22. The invention according to claim 16 wherein said hinge means comprises flexible fabric pieces directly attached to the flap member and directly attached to the ceiling.

23. The invention according to claim 22 wherein the fabric pieces are arranged at ends only of the flap member.

24. The invention according to claim 16 wherein the flap member comprises a substantially flat panel and wherein the spring means comprises an extension spring attached to an upper side of the flap panel at a position thereon spaced from the hinge means by a distance less than half the width of the panel and extending therefrom in a direction inclined toward a vertical plane containing the axis and wherein there is provided a stop member for engaging the spring as the flap member moves towards an opened position thereof to limit the movement of the flap member beyond a predetermined angle.

25. The invention according to claim 16 wherein the flap member is substantially L-shaped in cross section arranged such that one extremity of the L-shape engages said ceiling at said axis and extends therefrom towards an apex spaced from the ceiling with the other extremity of the L-shape engaging the ceiling on the side of the opening spaced from the axis and including triangular pieces closing ends of the L-shape and defining a substantially flat surface for engaging the ceiling at the ends of the flap member such that in the opened position the leg of the L-shape adjacent the opposed extremity lies across the opening to direct air therefrom across the ceiling in a direction substantially parallel thereto.

26. The invention according to claim 16 including an additional mass attached to said flap member so as to adjust the centre of gravity thereof.

27. The invention according to claim 16 including a projecting member cooperating between the ceiling and the flap member so as to hold the flap member in a slightly opened position to allow continual movement of air therepassed to prevent freezing.

28. The invention according to claim 16 including a gasket member mounted on the ceiling against which edges of said flap member engage.

29. The invention according to claim 16 wherein the flap member is shaped to define an apex thereof at said axis and engaging said ceiling along said axis and is shaped to define surfaces thereof, a first surface of which engages said ceiling in said closed position thereof and a second surface of which is arranged at an angle thereto to engage the ceiling in a fully opened position of the flap member so as to define an angle of movement of the flap member.

30. The invention according to claim 16 including a foamed member surrounding the opening and defining surfaces for engagement by said flap member, said foamed member defining an angle into which an edge of the flap member is pulled by said spring member, said angle defining said hinge means about which said flap member pivots.

* * * * *